United States Patent [19]

Ukmar et al.

[11] Patent Number: 4,789,256

[45] Date of Patent: Dec. 6, 1988

[54] RIBBON CARTRIDGE FOR PRINTING MACHINES

[75] Inventors: Boris Ukmar, Banchette; Mario Trompetto, Mercenasco, both of Italy

[73] Assignee: Ing. C. Olivetti & C., S.p.A., Ivrea, Italy

[21] Appl. No.: 22,675

[22] Filed: Mar. 6, 1987

Related U.S. Application Data

[62] Division of Ser. No. 582,738, Feb. 23, 1984, Pat. No. 4,669,902.

[30] Foreign Application Priority Data

Mar. 7, 1983 [IT] Italy ..... 67254 A/83

[51] Int. Cl.[4] ..... B41J 32/00

[52] U.S. Cl. ..... 400/208; 400/196.1; 400/235.1; 400/236.2; 400/234; 400/248

[58] Field of Search ..... 400/196.1, 207, 208, 400/208.1, 229, 233, 235, 235.1, 236.2, 234, 248, 214

[56] References Cited

U.S. PATENT DOCUMENTS

| | | | |
|---|---|---|---|
| 3,401,783 | 9/1968 | Norwood et al. | 400/229 X |
| 3,948,382 | 4/1976 | Nesbitt et al. | 400/229 X |
| 4,008,795 | 2/1977 | Garberi et al. | 400/201 X |
| 4,172,672 | 10/1979 | Oddicini et al. | 400/214 X |
| 4,231,667 | 11/1980 | Behrendt et al. | 400/229 X |
| 4,272,202 | 6/1981 | Schroeder et al. | 400/208 |
| 4,307,969 | 12/1981 | Daughters | 400/208 |
| 4,329,075 | 5/1982 | Applegate et al. | 400/229 |
| 4,422,786 | 12/1983 | Piptone | 400/208 X |
| 4,601,596 | 7/1986 | Musso | 400/214 X |
| 4,611,937 | 9/1986 | Sato et al. | 400/208 |
| 4,669,902 | 6/1987 | Ukmar et al. | 400/208 |

FOREIGN PATENT DOCUMENTS

| | | |
|---|---|---|
| 2757993 | 12/1977 | Fed. Rep. of Germany . |
| 2901058 | 12/1979 | Fed. Rep. of Germany . |
| 2003832 | 8/1978 | United Kingdom . |

*Primary Examiner*—Ernest T. Wright, Jr.

*Attorney, Agent, or Firm*—Banner, Birch, McKie & Beckett

[57] ABSTRACT

The ribbon (17) has an external run between the type element (25) and platen of a daisy-wheel typewriter. This run stretches between terminal members (59) which protrude from side arms (33 and 34) of the cartridge casing (18) and are fixed to the distal ends of arms (39, 41) pivotally mounted in the casing (18) at pivot (52). The arms (39, 41) are biased downwardly by wire springs (67) to expose the typing line. Ribbon lift levers of the typewriter raise the arms simultaneously to position a selected one of three tracks on the ribbon at the level of the typing point and a single drive shaft provides for the advancement of the ribbon. The cartridge comprises a feed spool and a take-up spool for the ribbon, a drive roller and a pressure roller which nip the ribbon internally to the casing, a transmission mechanism having a series of pinions and gears for transmitting the drive motion from the drive shaft of the typewriter to the pressure roller and to the take-up spool of the cartridge. A gear of the transmission mechanism is coaxial with the tke-up spool and is connected with the take-up spool by means of a friction clutch, which permits a slip motion between the gear and the take-up spool.

4 Claims, 8 Drawing Sheets

RIBBON CARTRIDGE FOR PRINTING MACHINES

This application is a division, of application Ser. No. 582,738, filed Feb. 23, 1984, now U.S. Pat. No. 4,669,902 issued June 2, 1987.

The present invention relates to a ribbon cartridge for typewriters or other printing machines, for example of the character carrying disc (daisy-wheel) type, comprising a typing ribbon having a plurality of transverse tracks which can be selected for the printing operation, a pair of guides between which a section of the ribbon is tensioned, outside the casing, and means which permit transverse displacement of the guides with respect to the casing for selecting one of said tracks. (Transverse means transverse relative to the ribbon).

A ribbon cartridge of this type has been described, wherein a pair of arms guides a section of the ribbon outside the casing. The two arms are pivoted on the casing and oscillate to move the selected track into a position in front of the character carrying disc. In such a cartridge, the angle of inclination of the section of ribbon disposed in front of the point of printing varies considerably during the oscillatory movement of the arms from the position at which the printing or typing is visible to the various track selection heights. In addition, the tensions to which the various transverse sections of the ribbon are subject to change substantially in dependence on the various operating positions of the ribbon. That gives rise to serious disadvantages, in particular when the ribbon is used in machines of the 'daisy-wheel' type in which the space available for the ribbon between the platen roller and the daisy-wheel is very small. It may in fact happen that, on certain occasions, the ribbon suffers from deformation or goes limp, with a substantial deterioration in the quality of printing and the danger of interference between the ribbon and the daisy-wheel, particularly in circumstances involving a plurality of repeated striking cycles.

The object of the present invention is therefore to provide a ribbon cartridge which is simple, and reliable in use, which makes it possible always to have the ribbon correctly tensioned, both in the rest position and in the various operating positions, and which also maintains a constant angle of inclination with respect to the line of printing.

This object is met by the cartridge according to the present invention which is characterised by the characterising portions of the independent claims.

Figure 1:
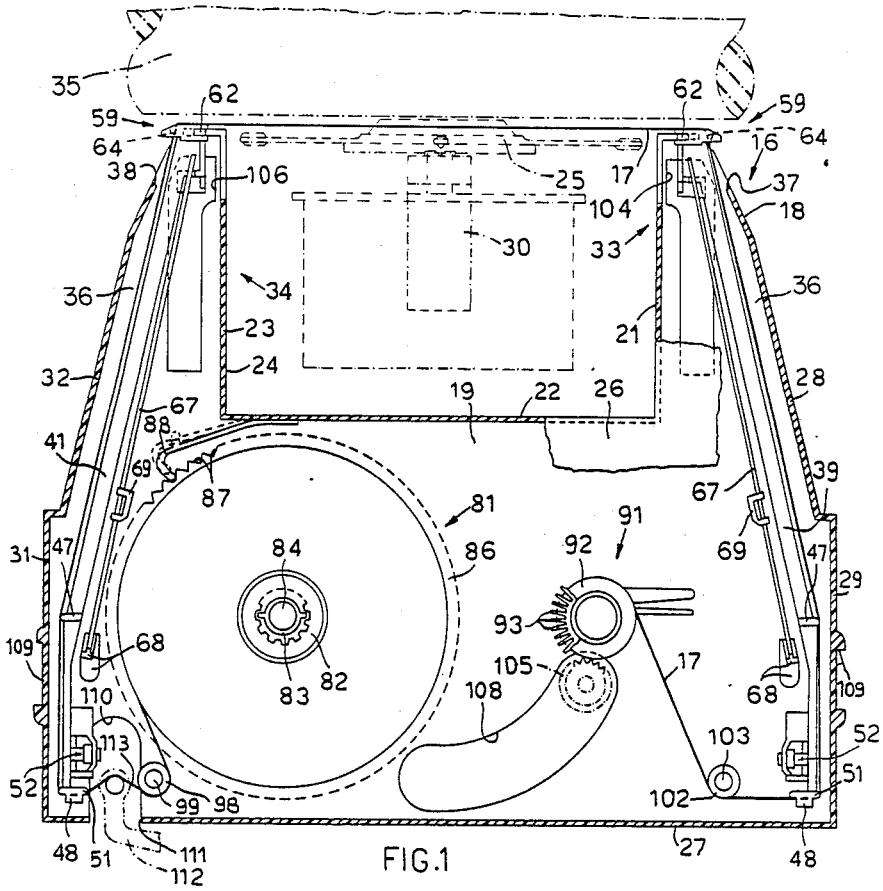
Figure 19:
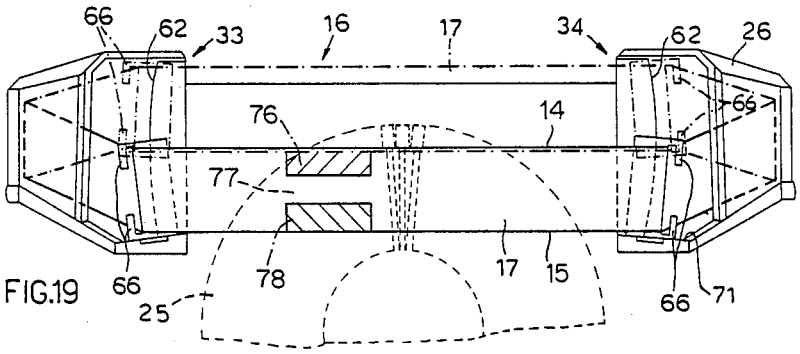
Figure 2:
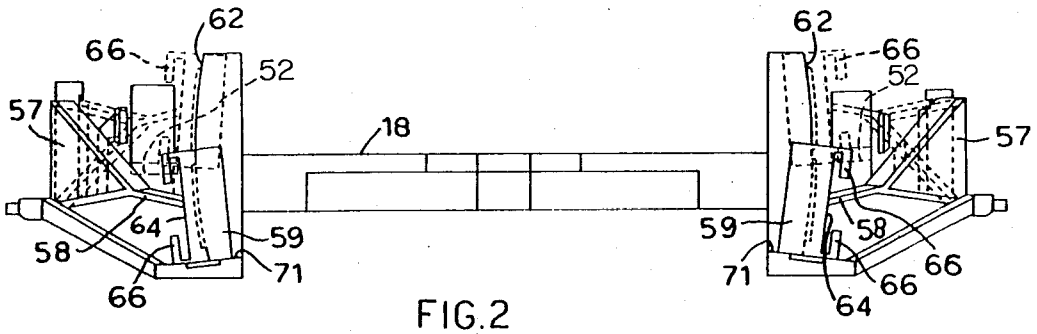
Figure 4:
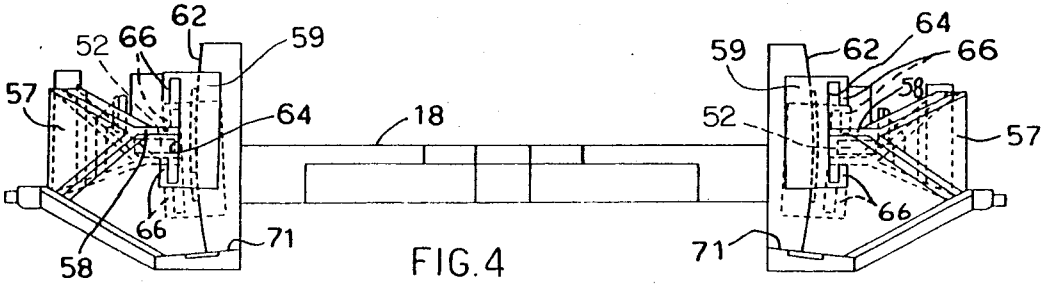
Figure 3:
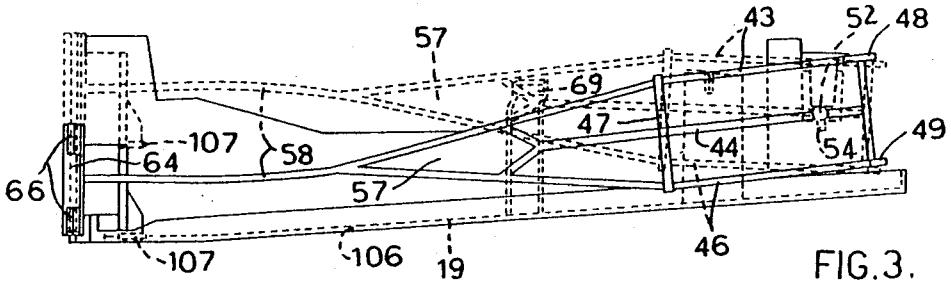
Figure 5:
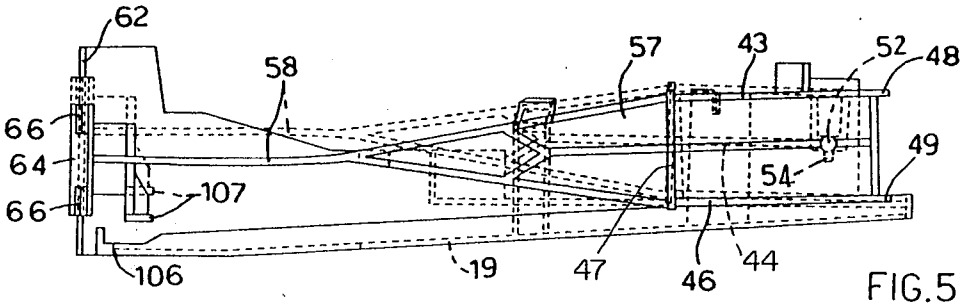
Figure 6:
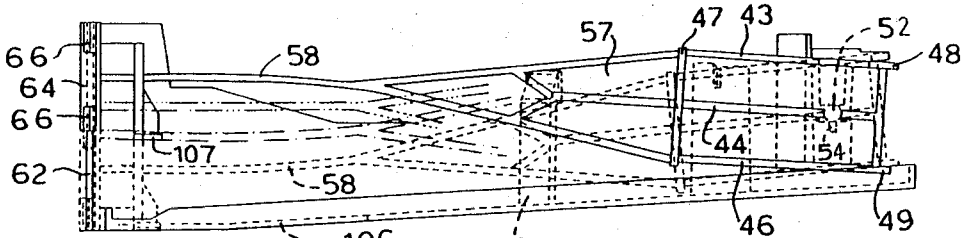
Figure 7:
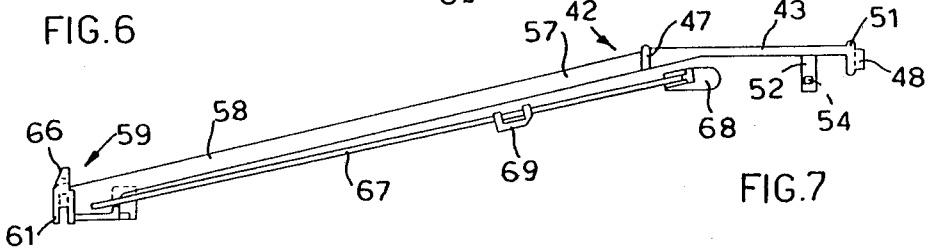
Figure 9:
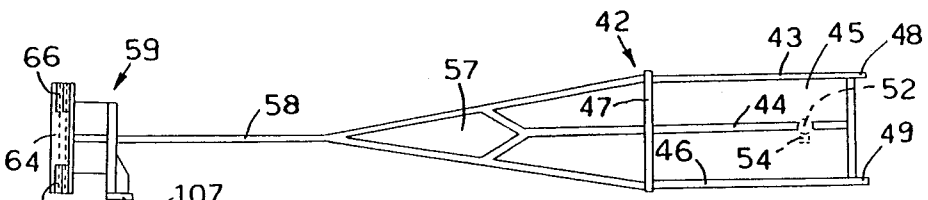
Figure 11:
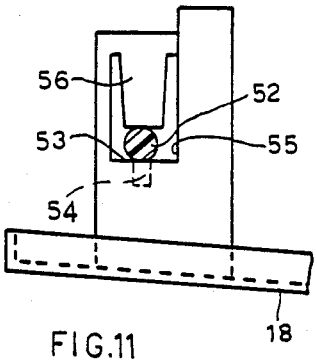
Figure 8:
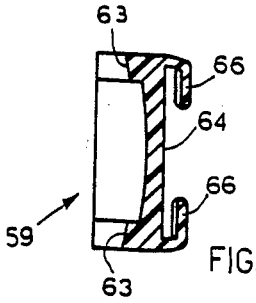
Figure 10:
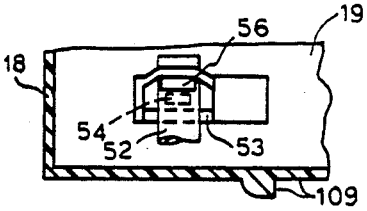
Figure 14:
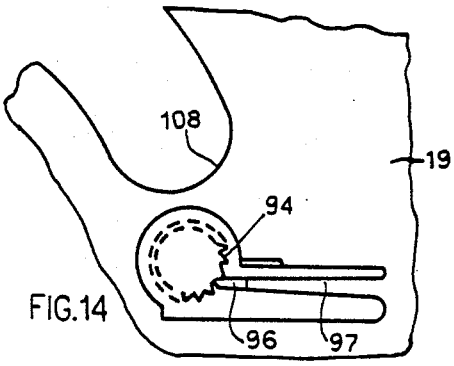
Figure 17:
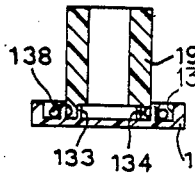
Figure 16:
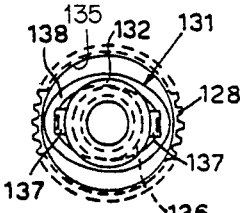
Figure 12:
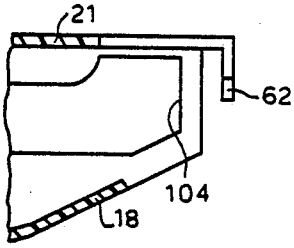
Figure 13:
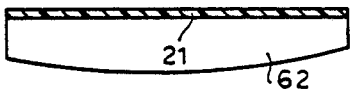
Figure 15:
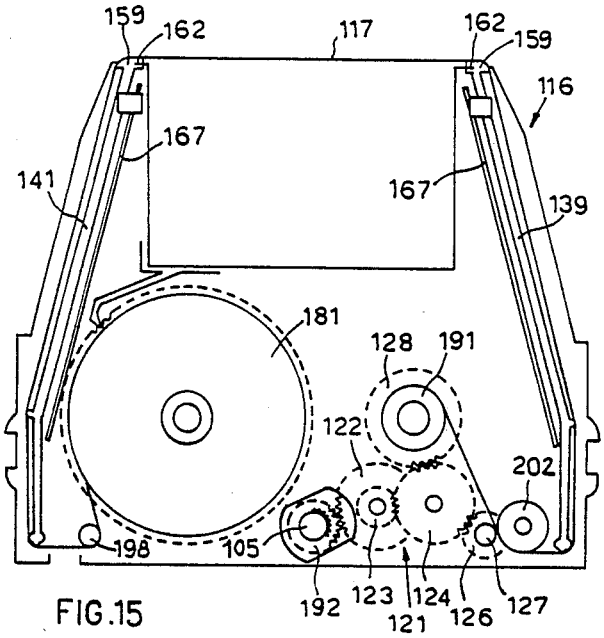
Figure 18:
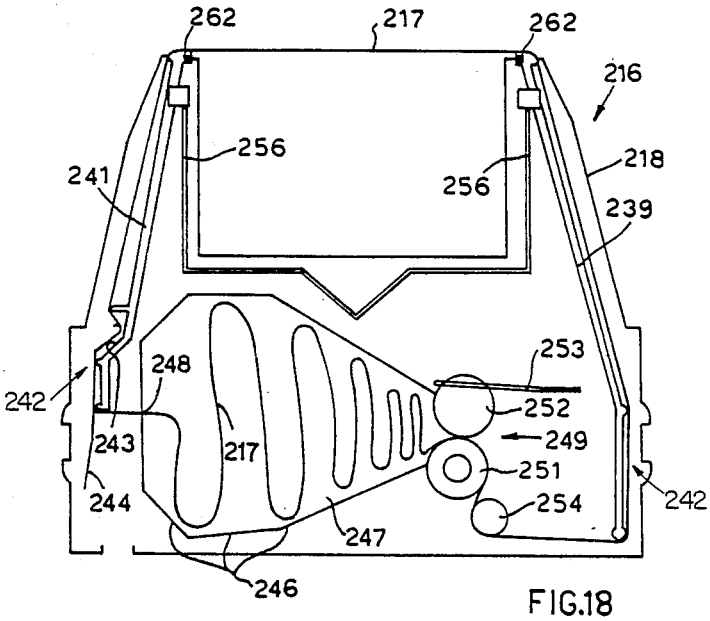
Figure 20:
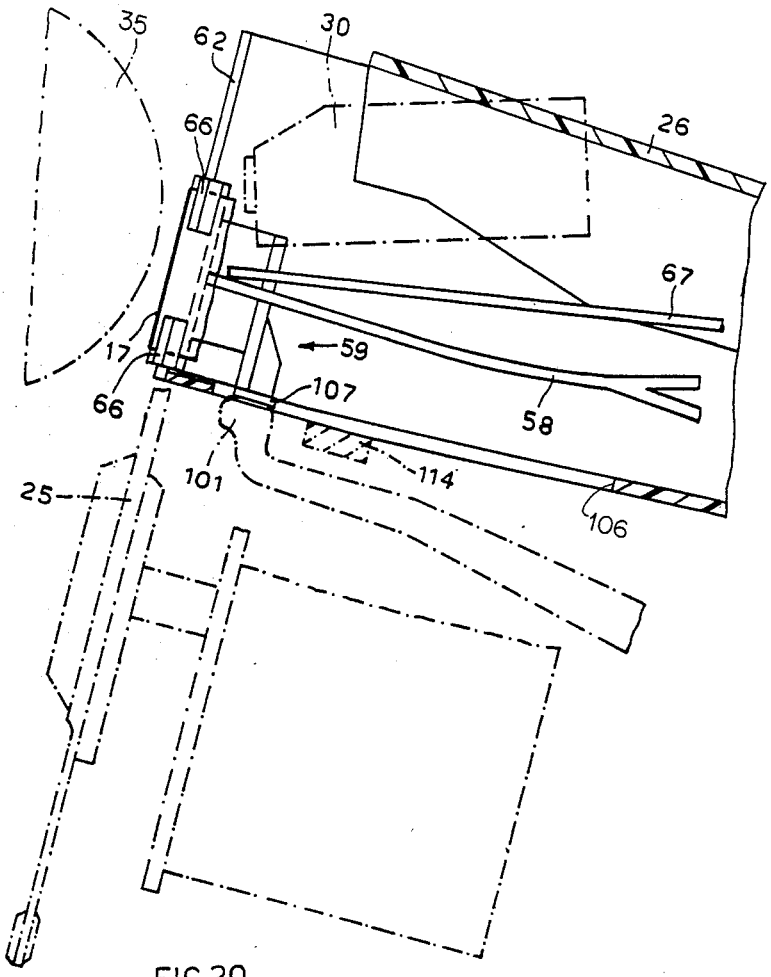
Figure 21:
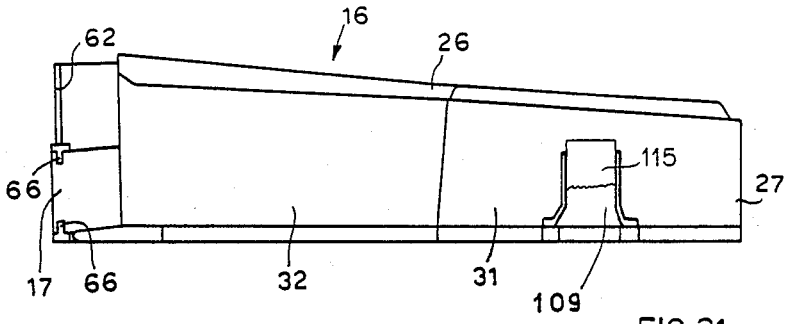
Figure 22:
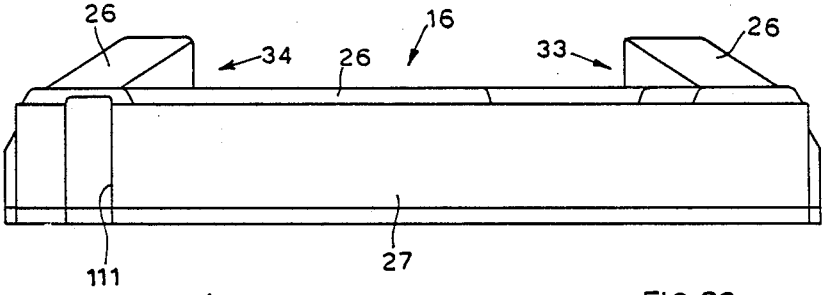

The invention will be described in more detail, by way of example, with reference to the accompanying drawings, in which:

FIG. 1 is a partial plan view of a ribbon cartridge embodying the invention, FIG. 2 is a partial front view of details from FIG. 1 in two operating positions, FIG. 3 is a partial side view of the details shown in FIG. 2 in the two operating positions shown therein, FIG. 4 is a partial front view of details from FIG. 1 in two other operating positions, FIG. 5 is a partial side view of the details shown in FIG. 4, in the two operating positions illustrated therein, FIG. 6 is a partial side view of the details shown in FIGS. 3 and 5 in the four operating positions, FIG. 7 is a partial plan view of details from FIG. 1, FIG. 8 is a partial view in section of details from FIG. 7 on an enlarged scale, FIG. 9 is a partial side view of a detail from FIG. 7, FIG. 10 is a partial plan view of details from FIG. 1 on a larger scale, FIG. 11 is a partial side view of the details shown in FIG. 10, on a larger scale, FIG. 12 is a partial plan view of a detail from FIG. 1, on a larger scale, FIG. 13 is a partial front view of the detail shown in FIG. 12, FIG. 14 is a partial plan view of details from FIG. 1, on a larger scale, FIG. 15 is a diagrammatic view of a first alternative embodiment of the cartridge according to the invention, FIG. 16 is a plan view of details from FIG. 15, on a larger scale, FIG. 17 is a view in section of part of FIG. 16, FIG. 18 is a diagrammatic view of a second alternative embodiment of the cartridge according to the invention, FIG. 19 is a partial front view of the cartridge of FIG. 1, in two operating positions, FIG. 20 is a partial longitudinal view of the cartridge shown in FIG. 1, on a larger scale, FIG. 21 is a diagrammatic side view of the cartridge shown in FIG. 1, and FIG. 22 is a diagrammatic rear view of the cartridge shown in FIG. 1.

In this description "front" and "rear" and related terms refer to the cartridge as mounted on a typewriter (as in FIG. 1) with "front" towards the operator, "rear" away from the operator.

Referring to FIG. 1, a cartridge 16 comprises a casing 18 of plastics material and of substantially parallelepipedic form, for a typing or printing ribbon 17. The casing 18 comprises a bottom portion 19 with rear wall portions 21, 22 and 23 which are arranged to define rearwardly a rectangular opening 24 for housing the upper part of a typing or printing mechanism, for example a character carrying disc 25 (daisy-wheel) and a hammer 30 which are known per se, are disposed in front of and adjacent to a platen roller 35 and shown in chain-dotted lines in the drawings. The platen roller 35 defines a printing point, not shown in the drawing, but substantially similar to the point of typing 12 shown in FIG. 1 of Musso U.S. Pat. No. 4,601,596. The casing 18 is closed upwardly by a cover 26 and is completed by a front wall 27 and side wall portions 28, 29, 31 and 32. The side wall portions 28 and 32 are convergent rearwardly of the cartridge 16 and, together with two projections 36 from the bottom portion 19 and with the rear wall portions 21 and 23, define two side arms 33 and 34 which are closed upwardly by the cover 26. The two arms 33 and 34 are provided at their ends with openings 37 and 38 and accommodate a right-hand ribbon guide arm 39 and a left-hand ribbon guide arm 41.

Each arm 39 and 41 comprises a blade 42 (see FIGS. 7 and 9) provided with a front portion 45 of substantially rectangular shape and a central portion 57 of triangular shape, which is extended rearwardly in a resilient blade 58. The blade 42 is provided with three longitudinal ribs 43, 44 and 46 and a transverse rib 47, the ribs 43, 44, 46 and 47 being provided to reinforce the blade structure. The longitudinal ribs 43 and 46 project with respect to the front edge of the blade 42 and form two limb portions 48 and 49 which are arranged to guide the ribbon 17 transversely when the arms 39 and 41 are mounted in the casing 18. The front edge of the blade 42 comprises a semi-cylindrical projection 51 for supporting the ribbon 17. The resilient blade 58 is connected to the ribs 43 and 46 and, at its rearward end, is provided with an arm and ribbon guide element 59.

Each blade 42 is provided at its forward portion with a pivot pin 52 which engages in a hole 55 (see FIGS. 10 and 11) in a support 53 of the casing 18 for pivoting the arm 39 and 41 movably with respect to the casing 18. A non-ribbed face of the front portion 45 is guided by the support 53 and a pip 54 prevents the pin 52 from becoming disengaged from the support 53. The hole 55 is limited in an upward direction by a resilient blade 56 which, when assembling the arms 39 and 41 in the casing 18, deflects under the thrust force applied by the end of the pin 52 to permit the pin 52 and its pip 54 to snap past.

The two guide elements 59 (see FIGS. 1, 7, 8 and 9) are of such a configuration as to perform the double function of engaging and guiding the ribbon 17 on the outside of the casing 18 and co-operating with a pair of cams 62 disposed at the ends of the arms 33 and 34 of the casing 18. In particular, the cams 62 have flat front and rear surfaces which are substantially parallel to the wall portion 22 of the casing 18, and a shaped outside edge, see FIGS. 2 and 4. each element 59 comprises a U-shaped fork or groove 61 in its inner side, the arms of which are arranged to co-operate with the flat surfaces of the cams 62 to prevent longitudinal movements of the arms 39 and 41 and the inside edge 63 of which is engaged and guided by the outside edge of the cam 62 to alter the inclination of the arms 39 and 41 during the oscillatory movements thereof. The guide element 59 further comprises a C-shaped seat portion 64 (FIG. 8) for guiding the ribbon 17 outside the casing 18, holding it engaged between two limbs 66.

On each side of the casing 18, a wire spring 67 is disposed between a fixed support 68 on the casing 18 and the guide element 59 of the respective arm 39, 41. A preloading element 69 which is downwardly offset bends the spring 67 in such a way as normally to hold the respective ribbon guide arms 39, 41 urged downwardly, with a lower end of the element 59 against a shoulder 71 (see FIG. 2) on the casing 18 (see FIG. 1).

Housed in the casing 18 is a feed spool 81, on which the ribbon 17 of the single-use or carbon film type is wound. The spool 81 comprises a core tube 82 with an inner sleeve 83 rotatably mounted on a pin 84 which projects from the bottom portion 19, and a flange 86 which is fixed to the bottom of the sleeve 83. At its outside edge, the flange 86 is provided with a series of peripheral notches 87 adapted to co-operate with a resilient blade 88 mounted on the bottom portion 19 of the casing 18 to prevent casual rotation of the spool 81 and thus uncontrolled unwinding of the ribbon 17.

Also housed in the casing 18 is a take-up spool 91, on which the ribbon 17 is wound after it has been used at the point of printing between the arms 33 and 34. The take-up spool 91 comprises a core tube 92 having at its upper end a series of radial ribs 93 which project from the cover portion 26 and which are capable of being manually engaged for manual rotary movement thereof. On the lower end of the core tube 92 is a series of saw teeth 94 (see FIG. 14) co-operating with a pawl 96 of a resilient blade 97 on the bottom portion 19. The saw teeth 94 are so disposed as to permit rotary movement of the core tube 92 (see FIG. 1) in the direction of winding of the ribbon 17 but co-operate with the pawl 96 (see FIG. 14) to prevent the core tube 92 from rotating in the other direction (see FIG. 1), even when the cartridge 16 is removed from the machine. In the specific case, they permit the core tube 92 to rotate in the anticlockwise direction and prevent it from rotating in the clockwise direction.

The ribbon 17 which is unwound from the spool 81 is guided around a roller 98 which is mounted rotatably on a pin portion 99 projecting from the bottom portion 19 of the casing 18, the engage with the semicylindrical projection 51 of the front of the left-hand ribbon guide arm 41, being held by the limb portions 48 and 49. The ribbon 17 then moves parallel to the blade 42 and bears against the transverse rib 47 of the left-hand ribbon guide arm 41 to be guided towards the C-shaped seat portion 64 of the arm 41 and ribbon guide element 59. The ribbon 17 then engages with the C-shaped seat portion 64 of the left-hand ribbon guide arm 41, to be guided parallel to the wall portion 22 until it engages with the C-shaped seat portion 64 of the right-hand ribbon guide arm 39. The ribbon 17 moves parallel to the right-hand guide arm 39 and is guided around the rib 47 of the right-hand ribbon guide arm 39 until it engages the semicylindrical projection 51 and then, guided by the limb portions 48 and 49, it engages with and is guided around a roller 102 mounted rotatably on a pin portion 103 of the bottom 19 of the casing 18, to be wound on the the take-up spool 91.

The casing 18 comprises two openings 104 and 106 which are provided in the bottom of the arms 33 and 34 of the cartridge 16 to permit a lifting arm 101 (see FIG. 20) to pass therethrough. The lifting arm 101 is controlled by a three-lobe cam, not shown in the drawing, already known such as the three lobe cam 244 shown in FIG. 10 of Oddicini et al. U.S. Pat. No. 4,172,672, for simultaneously positioning the right-hand ribbon guide arm 39 and the left-hand ribbon guide arm 41 in three operating positions. The lifting arm 101 is only partially shown and the three-lobe cam cannot be seen in the drawings. These elements are not described herein because they are substantially similar to those described in the U.S. Pat. No. 4,172,672 cited above. Each of the right-hand and left-hand ribbon guide arms 39 and 41 comprises a shoulder 107 which is disposed adjacent to the respective arm 33, 34 and ribbon guide element 59, being capable of co-operating with the lifting arm 101 referred to above, for positioning the respective arms 39 and 41 in one of the three operating positions described hereinbelow.

The casing 18 (see FIG. 1) comprises an aperture 108 in the form of a circular sector disposed adjacent to the take-up spool 91. The aperture 108 is arranged to receive a toothed wheel 105 co-operable with the ribbon 17, which is wound on the take-up spool 91 for winding the ribbon 17 thereon. The provision of a single line of teeth on the toothed wheel 105 ensures that the ribbon 17 is pulled through uniformly and parallel to the axis of the take-up spool 91. The toothed wheel 105 is known per se and is therefore only diagrammatically shown in the drawings.

The bottom portion 19 and the front wall portion 27 of the casing 18 are also provided with an aperture 110 and 111 adjacent to the portion of ribbon 17 between the roller 98 and the projection 51 on the arm 41. The apertures 110 and 111 are arranged to accommodate a lever 112 of the machine. The lever 112 reciprocates to take up slack and controls the unwinding of the ribbon 17 from the spool 81, thus forming a V-shaped loop 113 in the ribbon 17 between the components 98 and 51. That action is combined with that of the resilient blade 88 on the notches 87 and with the movement of the arm 41. One end of the ribbon 17 is fixed to the core tube 82 of the spool 81 and the lever 112 also signals to the machine, complete unwinding of the ribbon 17 from the spool 81 when the tension in the ribbon 17 eliminates the loop 113 formed by the ribbon 17.

The cartridge 16 is removably fixed to a fixed support 114 of the machine in known manner, for example by means of two resilient blade members 115 arranged to engage suitable seat portions 109 of the casing 18. The fixed support is diagrammatically indicated by reference numeral 114 (see FIG. 20), while only one of the resilient blade members 115 (which do not constitute subject matter of this patent), is partially shown in FIG. 21.

The typing or printing operation is performed by sequentially using three tracks 76, 77 and 78, as partially schematically represented only a portion of the ribbon 17 in FIG. 19 in order to simplify the drawing, which are disposed at three different levels on the ribbon 17. In order to simplify the description herein, only the mode of operation of the left-hand ribbon guide arm 41 will be described, being absolutely identical to the mode of operation of the right-hand ribbon guide arm 39. In order further to simplify the following description, solid lines in FIGS. 2 and 3 show the left-hand ribbon guide arm 41 in the viewing position, while broken lines show the left-hand ribbon guide arm 41 in the third operating position or at the third level of the ribbon 17. Solid and broken lines in FIGS. 4 and 5 show the first and second operating positions of the arm 41. FIG. 6 shows all four positions of the left-hand ribbon guide arm 41, the broken line showing the rest position, the dash-dotted line showing the first position or first level, the line comprising three dots and a line showing the second positions or second level and the continuous line showing the third position or third level.

FIG. 1 shows that the tension of the ribbon 17 and the force of the wire springs 67 hold the respective ribbon guide arms 39 and 41 in the rest position with the inside edge 63 against the cam 62 and with the lower part of the arms 39 and 41 and ribbon guide elements 59 against the shoulders 71 (see FIG. 2).

In accordance with the invention, the side surfaces of the cams 62 (see FIGS. 2, 3 and 19) define a plane of movement of the elements 59, which is parallel to the plane of rotary movement of the character disc 25 when the cartridge 16 is mounted on the support 114. The arms 39 and 41 can freely follow the movement of the elements 59 by virtue of the longitudinal play between pin portions 52 and the holes 55 in the supports 53 and the flexibility of the blade members 58. The side edge of the cams 62 is of substantially circular section and is followed by the central axis of the elements 59 when they are moved to select one of the three tracks 76, 77 and 78 on the ribbon 17. The distance between the rearward ends of the arms 39 and 41 is altered and compensates for the variation in length of the support means 64 for the ribbon 17, due to the necessarily rectilinear path of movement of the elements 59. Without the compensation effect, the middle section of the ribbon 17 would go limp or would stretch, when the ribbon 17 is raised to select one of the tracks 76, 77 and 78 thereof. The lateral distance between the ends of the arms 39 and 41 (see FIGS. 2 and 4) is at a minimum when the ribbon 17 is in the print viewing position and in the third operating position and is conversely at a maximum when the ribbon 17 is in the first and second operating positions.

When the ribbon 17 is in the first and second operating positions (see FIGS. 1, 4 and 5), the guide elements 59 are substantially vertical and parallel to the projections 51 and to the rollers 98 and 102 and the edges 14, 15 of the ribbon 17 have the same degree of tension as the respective central section. The arms 39 and 41 are of the maximum length compatible with the longitudinal dimensions of the cartridge 16. However, by virtue of the substantial travel of the arms 39 and 41 which is required to achieve a condition of visibility and for selection of the highest tracks 76, the edges 14, 15 of the ribbon 17 would tend alternatively to stretch and to go limp, giving rise to the danger of interfering with the character disc 25 (see FIG. 19). Those disadvantages are overcome by the effect of the cams 62 on the elements 59 which also modify the mutual inclination of the guide elements 59 of the ribbon 17 in such a way as to maintain a constant tension at the edges 14, 15 and at the central section of the ribbon 17, independently of the track 76, 77 or 78 selected.

The tension of the ribbon 17 and that of the wire springs 67 permit the elements 59 to follow the curvature of the cams 62. When the ribbon 17 (see FIGS. 2 and 19) is in the viewing position, the elements 59 converge downwardly. The length of the lower support means 64 of the ribbon 17 is therefore less than that of the upper support means 64. That compensates for the tendency of the upper edge 14 to go limp and the tendency of the lower edge 15 to become stretched. Conversely, when the ribbon 17 is in the third operating position, the ribbon guide edges of the elements 59 converge upwardly. The length of the upper support means 64 of the ribbon 17 is less than that of the lower support means 64, thus compensating for the tendency of the upper edge 14 to become stretched and the tendency of the lower edge 15 to go limp.

Referring now to FIGS. 2, 3 and 11, during the operation of lifting the ribbon 17, it will be seen that the left-hand ribbon guide arm 41 pivots with the pin portion 52 on the support 53 of the casing 18 and tends to rotate in the anticlockwise direction. Engagement and guiding of the U-shaped fork 61 by the cam 62 cause twisting and bending of the resilient blade member 58, causing deformation of the left-arm 41, while the arm and ribbon guide element 59 remains rigidly anchored to the cam 62 and holds the ribbon 17 tensioned in its rest position. If now we look at the broken line illustration, it will be seen that the left-hand ribbon guide arm 41, by pivoting on the pin portion 52, tends to rotate in the clockwise direction, but since the U-shaped fork 61 in engaged by the cam 62 and moves in a guided fashion along the cam 62, the resilient blade member 58 bends and twists in the opposite direction to the rest position, while the configuration of the cam 62 is such that the ribbon 17 remains tensioned in the fresh operating position, at the third level, as in the other rest and operating positions.

It will be clear therefore that the combined action of the cam 62 with the bending and twisting of the resilient blade member 58 make it possible to alter the lateral position of the arm 41 and ribbon guide element 59 in response to the transverse movement of the ribbon in such a way as to compensate for the variations in tension and thus accordingly to produce constant tension in the ribbon 17, both at its upper end 14 and at its lower tensioned edge 15. In a similar manner as described with reference to FIGS. 2 and 3, it will also be seen from FIGS. 4 and 5 that the combined action of the cam 62, with the bending effect of the resilient blade member 58, alters the lateral position of the arm 41 and ribbon guide element 59 in response to the transverse movement of the arm 41 and ribbon guide element 59 in such a way that the variations in tension are compensated for and they hold the ribbon 17 in a constantly tensioned condition.

It is also clear that the spacing between the pin portions 52 of the arms 39 and 41 and the elements 59 for guiding the ribbon 17 is virtually equal to the maximum longitudinal dimension of the cartridge 16. The curvature associated with the ribbon 17 being moved into the highest raised position thereof is therefore at a minimum, thereby reducing the necessity for corrections in respect of planarity of the ribbon 17.

It will be appreciated that the cartridge 16 for the typing ribbon 17 may be the subject of improvements and modifications, both in regard to the form and the arrangement of the various components and parts without thereby departing from the scope of the invention.

In particular, a first alternative embodiment is provided by use of a multi-use ribbon 117 (see FIG. 15) which can be mounted on a cartridge 116 which is substantially the same as the cartridge 16 shown in FIG. 1 and which is interchangeable therewith on the machine. In fact, the cartridge 116 (see FIG. 15) comprises a feed spool 181, a roller 198, two right-hand and left-hand ribbon guide arms 139 and 141 respectively, two wire springs 167, two cams 162 for guiding the respective arms 139 and 141, a roller 202 and a take-up spool 191, which are substantially the same as the corresponding components of the cartridge 16 (see FIG. 1) described above. Since the multi-use ribbon 117 (see FIG. 15) permits a plurality of characters to be struck on the same portion of the ribbon 117, mounted in the lower part of the cartridge 116 is a transmission device of gear type, which is generally denoted by reference numeral 121, for substantially reducing the number of revolutions of the take-up spool 191 with respect to the number of revolutions of the toothed gear 105. The transmission arrangement 121 does not interfere with the ribbon 117 which is wound on to the spool 191 and comprises a drive gear 122 which, when the cartridge 116 is mounted on the machine, is engageable with a pinion 192 disposed below the gear 105. The drive gear 122, buy means of a pinion 123, transmits the drive motion to an intermediate gear 124 and from there, by means of a pinion 126, to a pressure roller 127 which presses the ribbon 117 against the roller 202 for incremental advance movement of the ribbon 117. The movement of the take-up spool 191 is produced by means of a friction clutch arrangement 131 (see FIG. 16) and a gear 128 (see FIG. 15) engaged with the gear 124.

In each operating cycle in which the arms 139 and 141 are successively positioned at the first, second and third levels, as described hereinbefore, the combined action of the cams 162 with the bending of the resilient blade members 58 permit changes in the lateral position of the arm 139, 141 and ribbon guide device 159 in response to the transverse movement thereby to compensate for the variations in tension and thus to provide a constant tension in the multi-use ribbon 117, both at its lower edge 15 and at its upper edge 14.

The clutch arrangement 131 (see FIGS. 15, 16 and 17) permits a reduction in the revolutions of the spool 191 with respect to the gear 128 and winds on to the spool 191 the amount of ribbon 117 which is drawn by the rollers 127 and 202 independently of the amount of ribbon 117 which is already wound on the spool 191. Since movement of the gear 105 is prevented by the gear 122, the central teeth thereof will no longer engage the ribbon 117 which is wound on the spool 191. The take-up spool 191 comprises a tube member 132 having an internal seating or bearing means 133 which is arranged to be guided on a sleeve 134 projecting from the wheel 128. The tube member 132 comprises a circular groove 136 provided in the outside surface of the member 132 and disposed adjacent to the seating means 133. The gear 128 comprises two shoulders 137 which are positioned in diametrically opposite relationship to the sleeve 134 on the gear 128. A rubber ring 138 of circular section, which is commonly known as an O-ring, is mounted between the two shoulders 137 and is housed in the circular groove 136 in the tube member 132 whereby is acts as a brake on the take-up spool 191. The gear 128 comprises an internal cylindrical seat 135 for housing the two shoulders 137, the sleeve 134 and the rubber ring 138. If the force for winding the multi-use ribbon 117 on to the take-up spool 191 is lower than a predetermined loading value, the tension of the rubber ring 138 on the tube member 132 is such as to secure the spool 191 with respect to the wheel 128. If the force for winding the multi-use ribbon 117 on to the take-up spool 191 is higher than the above-mentioned predetermined value, the tension of the rubber ring 138 on the tube member 132 is such as to permit a slip motion as between the spool 191 and the gear 128 whereby the spool 191 does not rotate while the gear 128 continues its rotary movement, driven by the intermediate gear 124. In that case, there is a relative rotary movement as between the take-up spool 191 and the gear 128 and the rubber ring 138 behaves substantially like a clutch arrangement.

A second alternative embodiment is provided by virtue of the use of an inked or fabric ribbon 217 (see FIG. 18) which can be mounted on a cartridge 216 that differs slightly from the cartridge 16 shown in FIG. 1, in regard to its internal layout, but which is absolutely the same as regards external configuration and is interchangeable therewith. In the cartridge 216 also, the mode of operation of the right-hand and left-hand ribbon guide arms 239 and 241 and the cams 262 for guiding the respective arms 239 and 241 is substantially the same as in the cartridge 16 described hereinbefore. In fact, the right-hand ribbon guide arm 239 is substantially identical to the right-hand ribbon guide arm 39. The left-hand ribbon guide arm 241 has a blade member 242 which is shorter than the corresponding blade member 242 and the arm 239 and has a recess or cavity 243 for housing a blade spring 244. The spring 244 engages the fabric ribbon 217 and acts as a ribbon tensioning element, the lever 112 (FIG. 1) of the machine being inactive. Provided in the casing 218 are separator elements 246 which comprise internal wall portions of the casing 218, which define a magazine or storage region 247 in which the fabric ribbon 217 is disposed in coils which are distributed in a random arrangement. The storage region 247 is provided with a slot 248 for the ribbon 217 to issue therefrom. The cartridge 216 is provided with gear means 249 for feeding the ribbon 217 forward in one direction. The gear means 249 comprise a drive gear 251 and an idler gear 252 which is held in contact with the drive gear 251 by a spring 253. A guide roller 254 carries and guides the fabric ribbon 217 towards the gear means 249. A single double-arm spring 256 replaces the wire springs 67 in the cartridge 16, and, by operating in the same manner, provides that the respective arms 239 and 241 are always held in the respective rest positions, as described hereinbefore in relation to the wire springs 67. The higher degree of transverse flexibility of the fabric ribbon 217 and the provision of the ribbon deflection arrangement at 243 render negligible the effects of the greater amounts of deformation of the ribbon 217 as a result of using an arm 241 which is shorter than the arm 239.

We claim:

1. A ribbon cartridge for a typewriter or other printing machine of the type having a single drive shaft, and in which the cartridge comprises a casing; a ribbon; a take-up spool for the ribbon; a drive roller; and a pressure roller, which can be coupled to the single drive shaft for the unidirectional advance movement of the ribbon, and transmission mechanism between one of said drive roller and pressure roller and the take-up spool, wherein said transmission mechanism comprises a toothed wheel and the take-up spool has a hub member coaxial with the toothed wheel, and a friction clutch between the hub member and the toothed wheel, wherein said toothed wheel comprises a sleeve which projects axially from the toothed wheel and two shoulders which are positioned in diametrically opposite relationship to the sleeve, wherein said hub member includes an internal seat which is guided on the sleeve, and an outside circular groove adjacent to the internal seat;

wherein said friction clutch comprises a resilient ring which is mounted between said two shoulders of said toothed wheel and is housed in the outside circular groove of said hub member, and wherein said two shoulders cause the resilient ring to be put in traction and to assume an elongate shape provided with two sections which engage frictionally the outside circular groove of said hub member.

2. A ribbon cartridge according to claim 1 and to be used with a typewriter, wherein said single drive shaft comprises a drive pinion, wherein said transmission mechanism does not interfere with the ribbon wound onto the take-up spool, and further comprises a drive gear which, when the cartridge is mounted on the typewriter, is engageable with said drive pinion; a first driven pinion fixed coaxial with said drive gear; an intermediate gear which is in mesh with said first driven pinion; and a second driven pinion fixed coaxial with said pressure roller; wherein said intermediate gear is in mesh with said toothed wheel for transmitting the drive motion to the take-up spool by means of the friction clutch and wherein said intermediate gear is in mesh with said second pinion for transmitting the drive motion to said pressure roller which presses the ribbon against the drive roller for incremental advance movement of said ribbon.

3. A ribbon cartridge according to claim 1, wherein the toothed wheel comprises an internal cylindrical seat for housing said two shoulders, said sleeve and said resilient ring.

4. A ribbon cartridge according to claim 1, wherein said hub member is a portion of said take-up spool.

* * * * *